US005895881A

United States Patent [19]

Thiesen et al.

[11] Patent Number: 5,895,881

[45] Date of Patent: Apr. 20, 1999

[54] PROPELLANT CHARGE IGNITER

[75] Inventors: Stefan Thiesen, Willich; Manfred Lübben, Celle; Dieter Jungbluth, Herschbach, all of Germany

[73] Assignee: Rheinmetall Industrie AG, Ratingen, Germany

[21] Appl. No.: 08/904,833

[22] Filed: Aug. 1, 1997

[30] Foreign Application Priority Data

Aug. 2, 1996 [DE] Germany ..... 196 31 185

[51] Int. Cl.[6] ..... F42C 19/08

[52] U.S. Cl. ..... 102/202; 102/470

[58] Field of Search ..... 102/202, 204, 102/205, 380, 430, 431, 439, 469, 470, 472; 60/39.823, 256

[56] References Cited

U.S. PATENT DOCUMENTS

| | | | |
|---|---|---|---|
| 2,446,187 | 8/1948 | Meister . | |
| 2,995,088 | 8/1961 | Asplund | 102/202 |
| 4,335,653 | 6/1982 | Bratt et al. . | |
| 4,539,910 | 9/1985 | Stevens | 60/256 |
| 4,807,534 | 2/1989 | Vockensperger et al. | 102/202 |
| 5,052,302 | 10/1991 | Taddeo et al. . | |
| 5,140,906 | 8/1992 | Little, II . | |
| 5,704,640 | 1/1998 | Monk et al. | 102/202 |

FOREIGN PATENT DOCUMENTS

| | | | |
|---|---|---|---|
| 2343987 | 10/1977 | France | 102/470 |
| 2591735 | 6/1987 | France . | |
| 3416736 | 11/1985 | Germany . | |
| 3701145 | 8/1987 | Germany . | |
| 2134230 | 8/1984 | United Kingdom . | |
| 392 533 | 10/1990 | WIPO . | |

*Primary Examiner*—Harold J. Tudor

*Attorney, Agent, or Firm*—Venable; Gabor J. Kelemen; Ashley J. Wells

[57] ABSTRACT

A propellant charge igniter for cartridge ammunition, includes an ignition tube; and a transfer charge disposed within the ignition tube, wherein the ignition tube is composed of a jacket tube having defined therein a plurality of ignition openings; and a protective tube which is positioned within the jacket tube so that the outside wall of the protective tube rests flush against the inside wall of the jacket tube and covers the plurality of ignition openings, which is thin-walled and has a wall thickness ranging from 0.1 mm to 0.8 mm, which is arranged to effectively protect the transfer charge against adverse external environmental influences including humidity, and which is comprised of a material selected from the group consisting of glass, oxide ceramic material, glass ceramic material, metal or metal alloy, and plastic. This arrangement provides a reliable sealing of the transfer charge against external environmental influences over a long time period, e.g., at least 10 years, even if handled roughly.

14 Claims, 2 Drawing Sheets

PROPELLANT CHARGE IGNITER

BACKGROUND OF THE INVENTION

1. Field of The Invention

The invention relates to a propellant charge igniter for cartridge ammunition in which the charge igniter includes an ignition tube containing a transfer charge.

2. Description of the Related Art

In a propellant charge igniter of this type, the sensitive, explosive elements of the explosive train must be present in a protected, e.g., jacketed, form. The transfer charge of this explosive train is made from easily ignitable powder which burns up very quickly and propagates the flame very rapidly even with only a moderate pressure applied, and lies encapsulated in the metallic ignition tube of the propellant charge igniter in which ignition distribution bores are distributed over the entire length of he ignition tube. Up-to-date propellant charge igniters have ignition tubes which, in relation to the entire cartridge, have a maximum possible length in order to take the ignition flame unhindered into upper (front) propellant powder layers of the cartridge ammunition and in order to have an ignition surface available which is as large as possible by means of the ignition distribution bores.

For known propellant charge igniters of this type, a considerable expenditure is typically necessary for the sealing of the sensitive ignition elements against environmental influences. Therefore, especially the ignition openings and threaded parts of the ignition tube must be securely sealed to ensure the functioning of the propellant it charge igniter. If the ignition elements are not sufficiently protected against humidity, malfunctions or ignition delays occur when the propellant charge igniter is fired. With respect to demands of customers for the corresponding cartridge ammunition, sealing of the transfer charge must be reliably ensured for at least 10 years in humid and aggressively humid climates, even if the corresponding cartridge itself is not totally sealed against humidity.

From U.S. Pat. No. 2,446,187, a propellant charge igniter is known wherein, for the protection of the booster charge against external environmental influences, a thin-walled protective tube made from a lead/tin alloy is arranged within the jacket tube. Here, the protective tube rests flush against the inside wall of the jacket tube so that the ignition openings are covered. If the charge igniter is activated, the shock pressure punches out the ignition openings of the protective. However, the ignition flame in this arrangement is weakened by energy withdrawal due to simultaneous start of melting of the lead/tin alloy which thus results in delayed flame propagation through the ignition openings into the propellant powder of the cartridge. This time delay becomes measurably significant so that the required short ignition times, e.g., far below 50 ms, are not reached.

Furthermore, a propellant charge igniter of this design has the drawback that the material of the protective tube comprises lead constituents which are released when the cartridge is ignited and which reach the ambient air as toxic agents and pollutants. Finally, the use of such a protective tube made from a metal alloy will probably result in an impermissible increase in the internal pressure of the propellant charge igniter.

From European Patent No. 0 392 533 B1 and German Published Patent Application No. 37 01 145 A1, propellant charge igniters with ignition tubes are known wherein the ignition openings are covered by plastic sleeves applied on the outside of the respective jacket tube.

The drawback of these propellant charge igniters is that the respective plastic sleeve might be damaged in case of mechanical stressing of the cartridge, e. g., during jolting coincident with testing, because the edges of the hard propellant powder grains in the main charge of the cartridge can wear or damage the sleeve through friction and scoring, thus leading to a failure of the protection against the penetration of humidity into the propellant charge igniter.

German Patent No. 34 16 736 C2 discloses a propellant charge igniter wherein a protective casing is arranged on the inside of the jacket tube and is made from a heat-shrinkable plastic film. The protective casing holds together a transfer charge comprised of several ring pellets and encloses it firmly. During the ignition process, the propagation of the ignition flame is inhibited, however, because the blocking effect of the enclosing plastic thwarts a rapid, no-delay ignition of the entire transfer charge so that a measurable increase of the ignition time is noted.

It is therefore an object of the present invention to provide a propellant charge igniter having an ignition tube with an internally arranged protective tube which reliably seals the booster charge and the transfer charge against external environmental influences over a period of more than 10 years despite rough handling, the presence of shock-like temperature fluctuations, and/or storage under increased humidity conditions.

SUMMARY OF THE INVENTION

This and other objects are accomplished by the present invention which provides a propellant charge igniter for cartridge ammunition, comprising:

a. an ignition tube; and b. a transfer charge disposed within the ignition tube, wherein the ignition tube is comprised of:

- a jacket tube having defined therein a plurality of ignition openings; and
- a protective tube which is positioned within the jacket tube so that the outside wall of the protective tube rests flush against the inside wall of the jacket tube and covers the plurality of ignition openings, which is thin-walled and has a wall thickness ranging from 0.1 mm to 0.8 mm, which is arranged to effectively protect the transfer charge against adverse external environmental influences including humidity, and which includes at least one layer comprised of a material selected from the group consisting of:
  - (a) glass,
  - (b) oxide ceramic material,
  - (c) glass ceramic material,
  - (d) metal or metal alloy, and
  - (e) plastic.

Further advantageous embodiments of the invention are disclosed in the dependent claims.

The present invention is based on the concept of using a protective tube which rests tightly against the inside wall of the jacket tube and is comprised of a thin-walled material so that the cross-section of the tube remains open to the greatest possible extent for the passage of and propagation of ignition. Such demands are met particularly by protective tubes which are thin-walled, i.e., having a wall thickness ranging from 0.10 mm to 0.80 mm, preferably a wall thickness ranging from 0.15 mm to 0.60 mm, and are made from substances including glasses, oxide ceramic materials, glass ceramic materials, metals or metal alloys, and plastics. Wall thicknesses of less than 0.10 mm do not provide the desired reliable seal. Wall thicknesses of greater than 0.80 mm do not provide the desired rapidity of flame propagation during ignition of the corresponding cartridge ammunition.

When plastics are used for the protective tubes or inner liners, particularly advantageous embodiments of the invention proved to be those in which the protective tube or inner liner is comprised of an adhesive coated plastic layer (film), a blown plastic layer (film) or a combination of both such layers which are inserted into the ignition tube. When an adhesive coated plastic layer is employed, the adhesive coating layer is provided on the plastic layer and is positioned in contact with the inner wall of the jacket tube. Thus, the protective tube may be multi-layered and may be comprised of an adhesive layer, a first plastic layer, and a second plastic layer, wherein the adhesive layer is provided on the first plastic layer and is positioned in contact with the inner wall of the jacket tube, and wherein the second plastic layer is a blown film.

Furthermore, it proved to be advantageous to provide the protective tube with predetermined fracture points in the region of the ignition openings, particularly upstream thereof, i.e., towards the end of the ignition tube near the interior of the cartridge.

In a further advantageous application, the protective tube (inner liner) may be comprised of a plastic tube made from polyethylene (PE) or polypropylene (PP), particularly from polyethylene or polypropylene produced according to a rotational molding process or blow molding process, and most particularly with the production of the protective tube taking place within the ignition tube itself.

In a further advantageous embodiment, the protective tube may be composed of a mixed metal film, i.e., a metal alloy layer, which is protected by a coating of paint or varnish provided on at least one surface thereof. Preferably metallic cerium (Ce) is the main constituent of the mixed metal alloy and is present in an amount of more than 50 % by weight. Metal constituents of the alloy which would constitute pollutants when the cartridge ammunition is ignited, such as lead, are to be avoided as are metal alloys which melt simultaneously with ignition and would thus disadvantageously delay flame propagation.

In yet another advantageous embodiment, the protective tube is comprised of a layer of one of glass, oxide ceramic material or glass ceramic material. If the protection tube 10 has a wall thickness which is less than 0.3 mm, inclusion of a bonding layer for improving the connection with the interior side of the jacket tube has proven useful for protective tubes of this type. Advantageously, such thin* walled tubes may be coated with a silicone layer which provides an adhesive bond with the jacket tube so that stable support is provided. Thus, the protective tube advantageously further comprises a coating layer comprised of a thin silicone film. The silicone material may be a silicone fluid film having a thickness ranging from a monolayer up to a thickness effective to provide the desired adhesive bond, for example, about 10 micrometers. The silicone material may also be any silicone polymer which forms a film and has a thickness ranging from 1 to 100 micrometers.

BRIEF DESCRIPTION OF THE DRAWING

Further advantages and features will become apparent from the detailed description below taken with the drawings in which.

DESCRIPTION OF THE PREFERRED EMBODIMENTS

Figure 1:
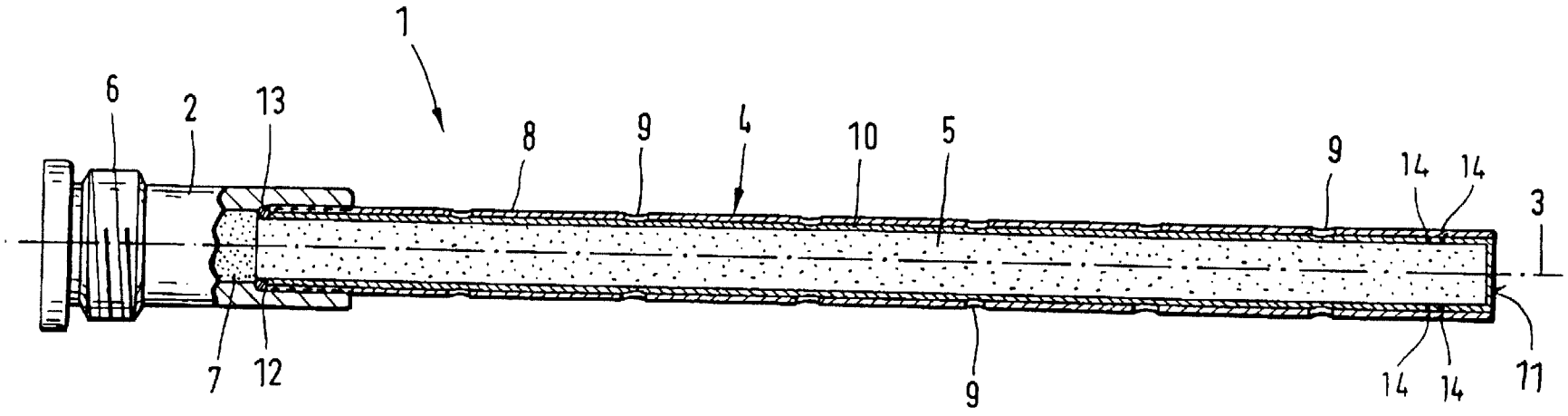
FIG. 1 illustrates in longitudinal cross-section a propellant charge igniter according to the invention which optionally includes a plurality of fracture points provided on the protective tube upstream of the ignition openings.

FIG. 1 illustrates in longitudinal cross-section a propellant charge igniter according to the invention. Propellant charge igniter 1 is comprised of a head section 2 and an ignition tube 4 adjoining the head section 2 in the direction of longitudinal axis 3 of the charge igniter 1. The head section 2, which comprises a percussion cap (not shown) and a booster charge 7, is provided with an external thread 6 with which the propellant charge igniter 1 is screwed into the bottom of a corresponding ammunition cartridge (not shown).

Ignition tube 4 is filled with a transfer charge 5 and is comprised of a jacket tube 8 made of steel and provided with a plurality of ignition openings 9 and a seal in the form of an inner liner or protective tube 10 which is arranged on the inside surface of the jacket tube 8 and which covers the plurality of ignition openings 9. Ignition openings 9 rupture during ignition and, moreover, a plurality of fracture points 14 optionally may be provided on protective tube 10 upstream of the ignition openings 9 to further expedite ignition flame propagation.

The ignition tube 4 has a front end 11 and a side 12 facing the head section 2 of the propellant charge igniter 1. The inner liner or protective tube 10 is closed at the front end 11 of the ignition tube 4 and sealed on the side 12 facing the head section 2 of the propellant charge igniter 1 by means of a seal 13 made from an elastic material, such as a rubber, for example, neoprene.

Figure 2:
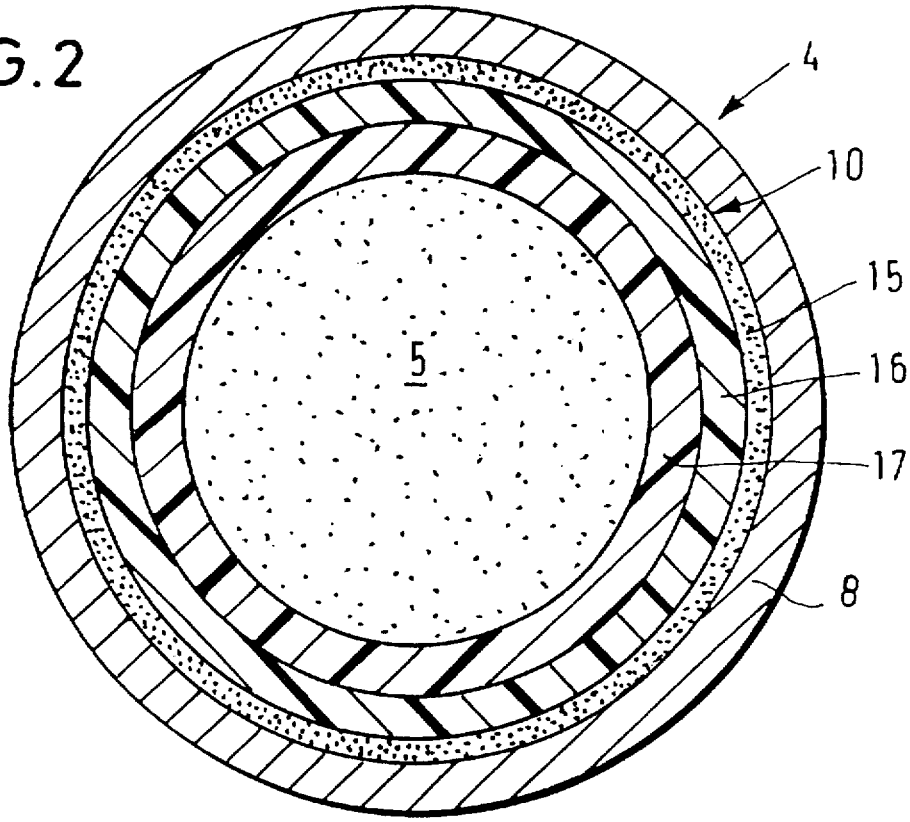
FIG. 2 illustrates in cross-section a propellant to charge igniter according to the invention in which the protective tube includes first and second plastic layers and an adhesive layer provided between the first plastic layer and the jacket tube.
Figure 3:
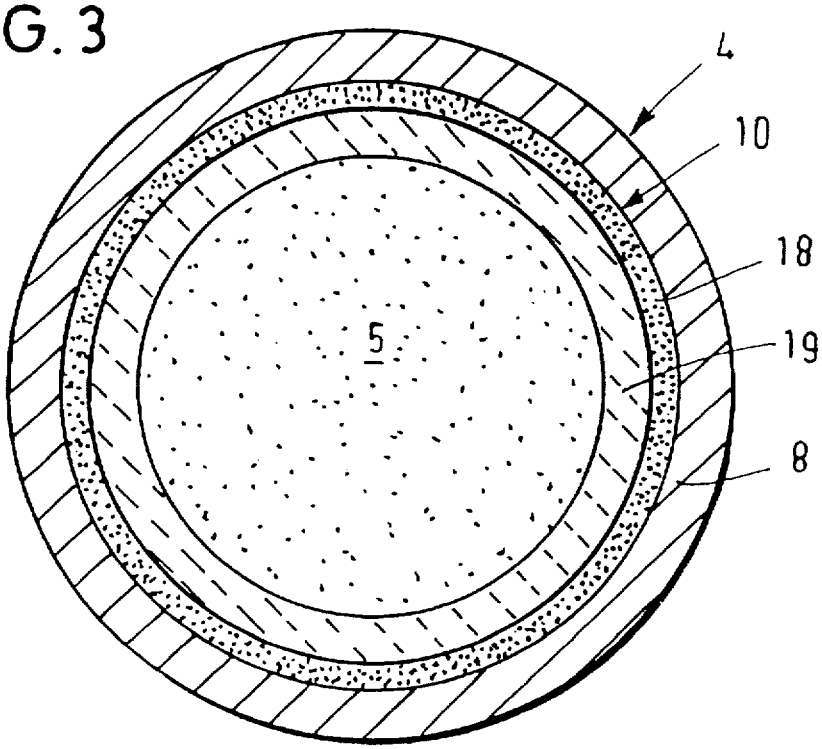
FIG. 3 illustrates in cross-section a propellant charge igniter according to the invention in which the protective tube includes a glass layer, an oxide ceramic material layer or a glass ceramic material layer and a coating layer comprised of a thin silicone film provided between the glass layer, the oxide ceramic material layer or the glass ceramic material layer and the jacket tube.

The inner liner or protective tube 10 may be fabricated as a single layered structure as in FIG. 1 or a multi-layered structure as in FIGS. 2 and 3. Examples of such structures for the inner liner or protective tube 10 include a polymeric layer glued-in with an adhesive layer, a blown polymeric layer, a polymeric layer glued-in with an adhesive layer in combination with a blown polymeric layer, a metal or metal alloy layer, and a glass layer, an oxide ceramic material layer or a glass ceramic material layer with a silicone adhesion coating layer.

FIG. 2 illustrates in cross-section a propellant charge igniter according to the invention in which the protective tube includes first and second layers 16, 17 comprised of plastic material and an adhesive coating 15 provided between the protective tube and the jacket tube.

FIG. 3 illustrates in cross-section a propellant charge igniter according to the invention in which the protective tube is comprised of a glass layer, an oxide ceramic material layer or glass ceramic material layer 19 and a coating 18 comprised of a thin silicone film provided between the protective tube and the jacket tube.

The following examples illustrate, by way of example but not limitation, several materials and methods for insertion of the protective tube 10 into the jacket tube 8.

EXAMPLE 1

A glued-in film is useful as protective tube 10. For this purpose, a plastic film 16 (see FIG. 2) having a wall thickness with a maximum of 0.25 mm and being coated with an adhesive layer 15 that can be thermally activated, was inserted into the jacket tube 8 and heated to a temperature effective to activate the adhesive, e.g., to a temperature ranging from above about 65° C. up to about 180° C. The adhesive layer 15 is a thin layer having a thickness ranging from a monolayer up to about 100 micrometers. The ready-for-bonding film 15, 16 thus produced was then glued onto the interior side of jacket tube 8 by applying pressure thereon from within.

Laminated polyurethane (PU)/polyolefin (PE or PP) films have proven useful as protective tube materials. In particular, a polyethylene film coated with, for example, a reactive two-component polyurethane adhesive which cross-links when heated has been used. Adhesives based on polychloroprene, cyanoacrylate, etc. are also suitable.

EXAMPLE 2

A blown film has been used as a protective tube 10. For this purpose, a parison, i.e., a plastic sleeve in the molten state, was extruded into the jacket tube 8. A mold having a corresponding blow opening surrounded jacket tube 8. By means of blown-in air, the parison was then pressed against the inside wall of jacket tube 8 where it was cured in place. Thermoplastic polymers, such as polyethylene (PE), polypropylene (PP), polyethyleneglycol terepthalate (PET), polymethylene pentene (PMP), and copolymers and terpolymers of ethylene-propylene diamine (EPDM) have proven useful as parison materials. Thermoplastic fluororubbers and other thermoplastic elastomers are also suitable. Of primary importance for the selection of a suitable material for protective tube 10 is that the material have a high barrier effect vis-a-vis humidity and water. The wall thickness should be effective for this criteria and preferably ranges from 0.15 mm to 0.6 mm.

EXAMPLE 3.

A multi-layered structure is useful for protective tube 10. The protective tubes according to Examples 1 and 2 may be combined into a multi-layered structure, see FIG. 2. First, a film in accordance with Example 1 above is positioned inside of jacket tube 8 and then a parison in accordance with Example 2 is inserted therein and blown in place. Blowing in place of the molten parison applies heat and pressure onto the film in accordance with Example 1 and serves to glue this adhesive coated film in place and in contact with the inner surface of the jacket tube.

EXAMPLE 4.

An oxide ceramic or glass ceramic is useful for protective tube 10. Protective tubes 10 which are closed on one side and are self-supporting must be sufficiently stable so that they can cushion mechanical stresses, e. g., jolting from impacts and vibration. Protective tubes 10 made from an oxide ceramic material or glass ceramic material having a wall thickness ranging from 0.3 mm to 0.6 mm have proven to be particularly suitable.

Such a tube is open when viewed from the perspective of the ignition section and is therefore provided on the head section 2 with a thickened rim which is folded inwardly or outwardly (not shown). The rim has a groove channel (not shown). The groove can receive a sealing O-ring or a resilient sealing ring (not shown). The front end 11 of the jacket tube 8 is closed off. To secure a tight seat of the protective tube 10 in the region of the front end 11, a resilient ring element (not shown) made from soft rubber may be provided there as well.

Oxide ceramic materials based on zirconium oxide or on aluminum oxide stabilized with zirconium oxide have a good bending behavior and are useful particularly where increased mechanic stresses are likely.

If the protection tube 10 has a wall thickness which is less than 0.3 mm, a bonding layer for improving the connection with the interior side of the jacket tube 8 has proven useful for protective tubes of this type, see FIG. 3. Advantageously, a tube 10 with such a thin-walled layer 19 may be coated with a silicone layer 18 which provides an adhesive bond with the jacket tube so that stable support is provided.

The invention is not limited to the above-described embodiments. Thus, particularly the protective tubes made from plastic can be made, for example, not only by means of molding, blow molding, or rotational molding but also by means of injection molding or other extrusion techniques.

It is understood that various other modifications will be apparent to and can be readily made by those skilled in the art without departing from the scope and spirit of the present invention. Accordingly, it is not intended that the scope of the claims appended hereto be limited to the description set forth above but rather that the claims be construed as encompassing all of the features of patentable novelty which reside in the present invention, including all features which would be treated as equivalents thereof by those skilled in the art to which the invention pertains.

What is claimed is:

1. A propellant charge igniter for cartridge ammunition, comprising:

a. an ignition tube; and b. a transfer charge disposed within the ignition tube, wherein the ignition tube is comprised of:

a jacket tube having defined therein a plurality of ignition openings; and a protective tube which is positioned within the jacket tube so that an outside wall of the protective tube rests flush against an inside wall of the jacket tube and covers the plurality of ignition openings, which is thin-walled and has a wall thickness ranging from 0.1 mm to 0.8 mm, which is arranged to effectively protect the transfer charge against adverse external environmental influences including humidity, and which includes at least one layer comprised of a material selected from the group consisting of:

(a) glass, (b) oxide ceramic material, (c) glass ceramic material, (d) metal or metal alloy, and (e) plastic.

2. The propellant charge igniter according to claim 1, wherein the wall thickness of the protective tube ranges from 0.15 mm to 0.6 mm.

3. The propellant charge igniter according to claim 1, wherein the wall thickness of the protective tube is less than 0.3 mm, and wherein the protective tube further comprises a coating layer comprised of a thin silicone film.

4. The propellant charge igniter according to claim 1, wherein the at least one layer of the protective tube is comprised of a layer of said glass.

5. The propellant charge igniter according to claim 1, wherein the at least one layer of the protective tube is comprised of a layer of one of said oxide ceramic material or said glass ceramic material.

6. The propellant charge igniter according to claim 1, wherein the at least one layer of the protective tube is comprised of a layer of said metal or metal alloy, which metal or metal alloy is consumable during ignition.

7. The propellant charge igniter according to claim 6, wherein the protective tube is comprised of a layer of metal alloy comprising more than 50% by weight of cerium and a protective coating comprised of one of a paint or varnish.

8. The propellant charge igniter according to claim 1, wherein at least one of the at least one layer of the protective tube is comprised of said plastic and is one of polyethylene or polypropylene.

9. The propellant charge igniter according to claim 8, wherein said plastic is formed into said at least one layer by a process selected from the group consisting of rotational molding and blow molding, and wherein said process is conducted inside of the jacket tube.

10. The propellant charge igniter according to claim 8, wherein the protective tube further comprises an adhesive layer provided between the jacket tube and the at least one layer comprised of said plastic.

11. The propellant charge igniter according to claim 1, wherein one layer of the at least one layer of the protective tube is comprised of said plastic and is a blown film.

12. The propellant charge igniter according to claim 1, wherein the protective tube is multi-layered and is comprised of an adhesive layer, a first plastic layer, and a second plastic layer, wherein the adhesive layer is provided on the first plastic layer and is positioned in contact with the inner wall of the jacket tube, and wherein the second plastic layer is a blown film.

13. The propellant charge igniter according to claim 12, wherein the second plastic layer is comprised of said plastic and is comprised of one of polyethylene or polypropylene.

14. The propellant charge igniter according to claim 1, wherein the protective tube is provided with preselected fracture points upstream of the plurality of ignition openings.

* * * * *